United States Patent [19]

Schriwer

[11] Patent Number: 4,622,885

[45] Date of Patent: Nov. 18, 1986

[54] HYDROSTATIC PISTON PUMP OR ENGINE HAVING DIAGONAL PISTON AXIS

[76] Inventor: Sven Schriwer, Trädgardsgatan 36, S-461 42 Trollhättan, Sweden

[21] Appl. No.: 783,929

[22] PCT Filed: Jan. 29, 1985

[86] PCT No.: PCT/SE85/00039

§ 371 Date: Sep. 23, 1985

§ 102(e) Date: Sep. 23, 1985

[87] PCT Pub. No.: WO85/03554

PCT Pub. Date: Aug. 15, 1985

[30] Foreign Application Priority Data

Jan. 31, 1984 [SE] Sweden ..... 8400473

[51] Int. Cl.[4] ..... F01B 13/04

[52] U.S. Cl. ..... 91/487; 91/499

[58] Field of Search ..... 91/484–488, 91/499, 506, 507

[56] References Cited

U.S. PATENT DOCUMENTS

| | | | |
|---|---|---|---|
| 1,817,080 | 8/1931 | Howard | 91/485 |
| 2,718,758 | 9/1955 | Minshall | 91/507 |
| 2,895,426 | 7/1959 | Orshansky | 91/485 |
| 3,186,352 | 6/1965 | Anderson | 91/507 |
| 3,618,471 | 11/1971 | Hein et al. | 91/485 |
| 3,657,970 | 4/1972 | Kobayashi | 91/485 |
| 3,802,321 | 4/1974 | Bosch | 91/485 |
| 4,546,692 | 10/1985 | Lotter | 91/488 |

FOREIGN PATENT DOCUMENTS

| | | | |
|---|---|---|---|
| 941343 | 3/1956 | Fed. Rep. of Germany | 91/472 |
| 2215684 | 10/1973 | Fed. Rep. of Germany | 91/499 |
| 568638 | 11/1957 | Italy | 91/488 |
| 311938 | 5/1929 | United Kingdom | 91/485 |
| 1024858 | 2/1964 | United Kingdom | 91/507 |

*Primary Examiner*—William L. Freeh

*Attorney, Agent, or Firm*—Balogh, Osann, Kramer, Dvorak, Genova & Traub

[57] ABSTRACT

New type of piston machine operating as a piston pump or piston engine, preferably called a diagonal engine, which, with the aid of hydrostatic bearings, is constructed with the cylinder through-bores having an area free throughout from any construction points. Due to the considerable angle at which the cylinder bores are disposed, a very long stroke can be obtained for the piston compared with the stroke-length possible with other hydrostatic piston pumps and piston engines.

6 Claims, 6 Drawing Figures

1
2
3
4
5
6
7
8
9
10
11
12
13
14
15
16.
17.
18
α
β
β

31
33
32
34
35
36
37
38
39
40
41
42
43
44
45
46
20
21
22
23
20°
20°

HYDROSTATIC PISTON PUMP OR ENGINE HAVING DIAGONAL PISTON AXIS

In the technical field of hydraulic piston pumps and engines there are two basic types: axial piston machines and radial piston machines. As the designations indicate, the piston movements are substantially axial or radial relative to the axes of symmetry of the machines. According to the function of the machine, there are variations of these basic types, such as bent axis machines, where the cylinder body is pivoted up at a maximum of ±40°, and radial piston machines which operate with pivoting pistons. Moreover, in a number of axial piston machines, both of the bent axis type and the in-line type, the cylinder bores are orientated at a slight angle to the axis of the cylinder casing. The angles of inclination which occur are normally up to a maximum of approximately 5°.

In the present invention a considerably greater angle of inclination is used for the cylinder bore relative to the axis of the cylinder casing, to allow greater stroke length for the pistons and to make more room for the homokinetic Cardan joint which is used to transmit the piston power developed to the machine shaft as usable torque, and vice versa.

Figures 1, 1A:
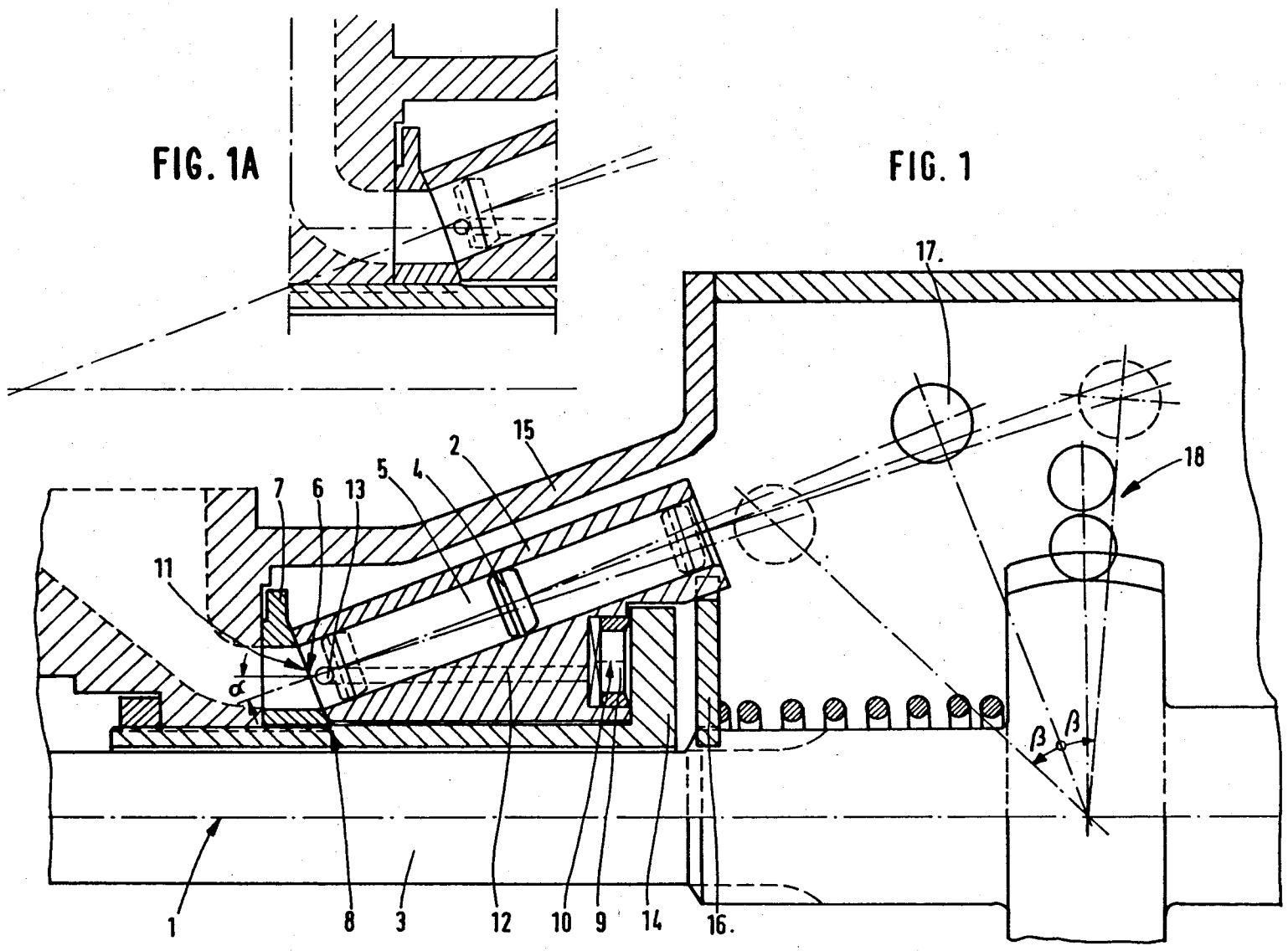

The invention is described in the following with reference to the accompanying drawings, on which FIG. 1 shows the basic design of the machine, FIG. 1*a* shows an enlarged portion of FIG. 1.

Figures 2, 3, 3A:
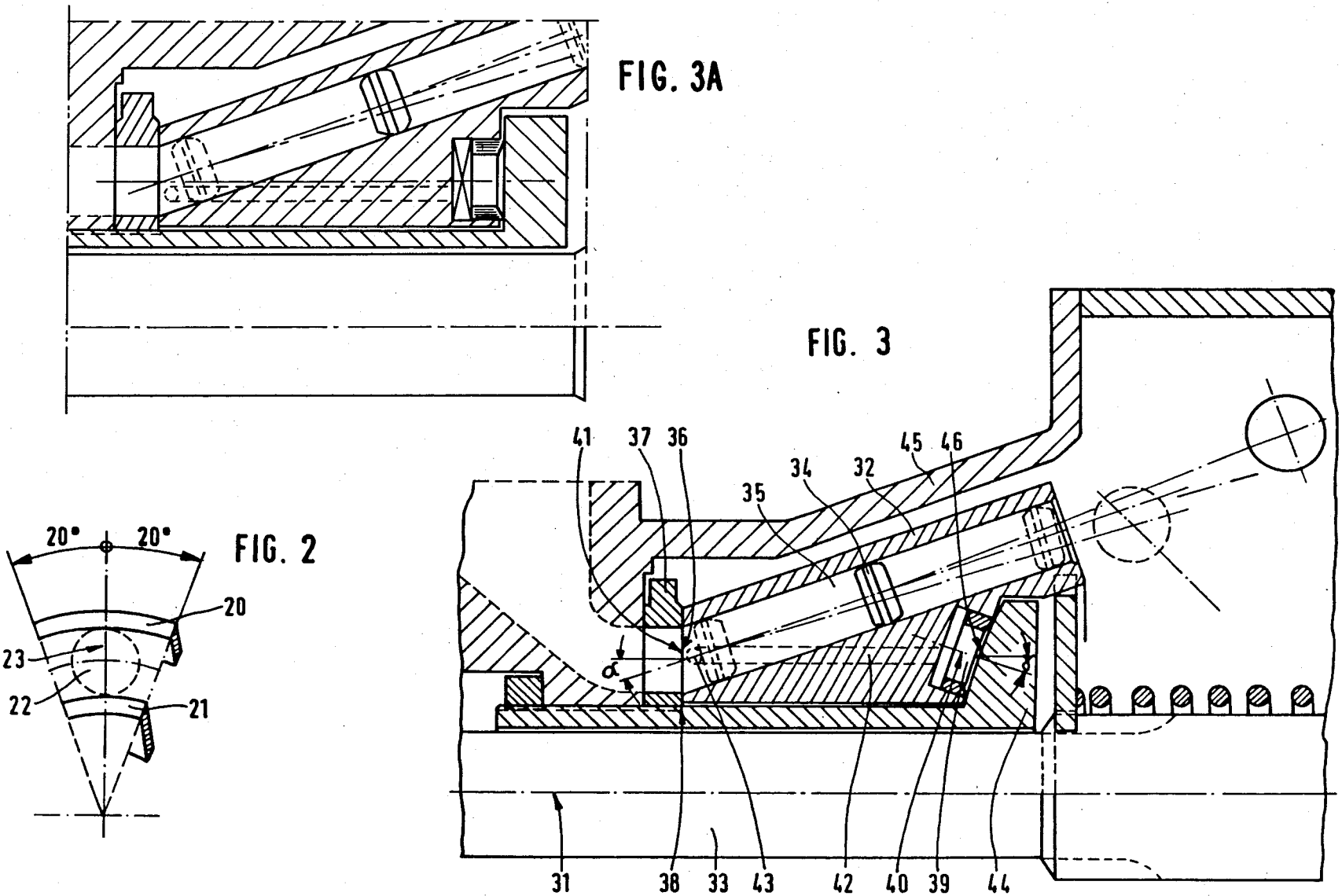
Figure 4:
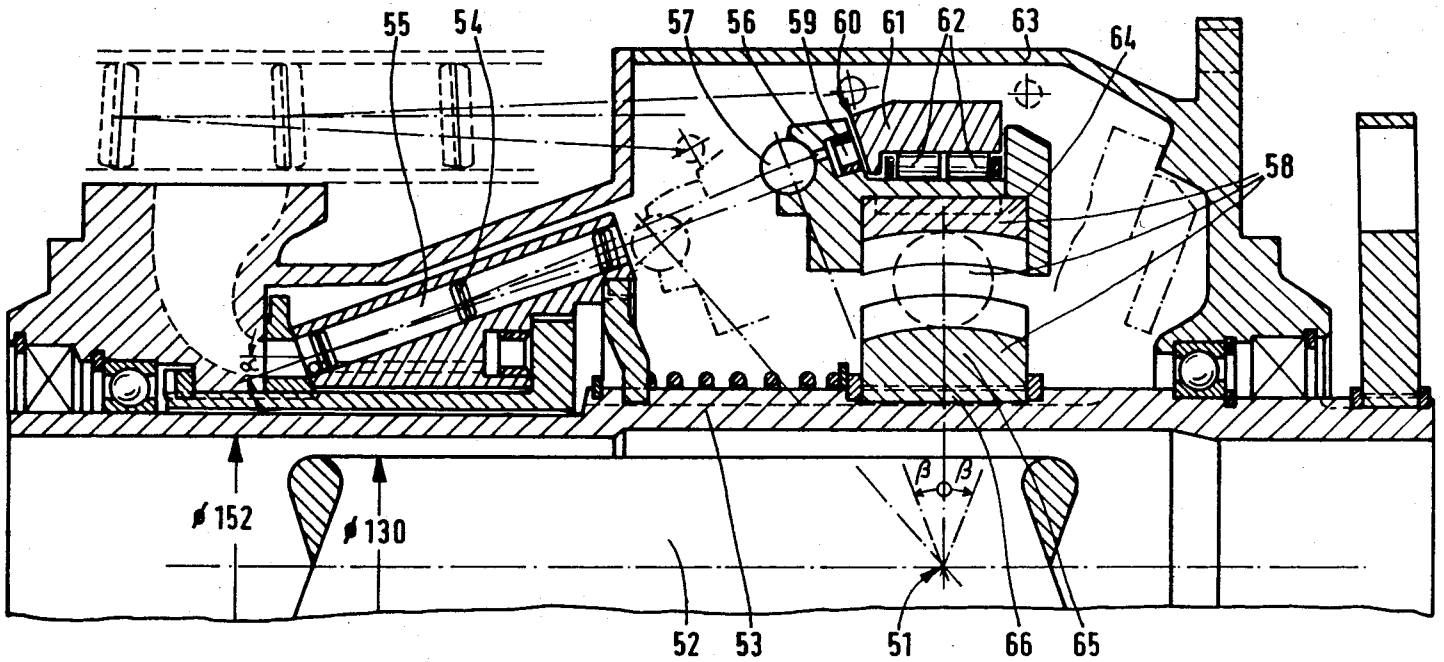

FIG. 2 shows a section of the contact surface between a valve plate and the cylinder casing, FIG. 3 shows a version of the machine which is very similar to the machine shown in FIG. 1 but has the valve plate plan-parallel, and therefore has its hydrostatic bearings acting at a specific angle, FIG. 3*a* shows an enlarged portion of FIG. 3 and FIG. 4 shows a complete machine constructed with 26 pistons and a very large-dimension shaft passing through it.

The basic design of the machine shown in FIG. 1 shows clearly that it has a common centre of rotation 1 for both the cylinder casing 2 and the drive shaft 3. Thus, a so-called in-line machine is involved which, dependent mainly on the number of working pistons 4, can be constructed with a large-dimension shaft 3 through it. By this means two, three or more machines can be connected in a row one after the other to a common drive shaft without the need to instal a costly distributor shaft.

FIG. 1 also shows that spherical pistons 4 are used in the invention, although these are not essential to the invention. Conventional cylindrical pistons with a movable piston rod can be used, but spherical pistons 4 give the smallest dimensions for the cylinder casing 2 and thus for the whole machine.

The cylinder casing 2 with its cylinder bores 5 extending at a considerable angle of inclination $\alpha$ to the axis of symmetry 1 of the machine can be produced with an arbitrary number of such cylinder bores. For special purposes, diagonal piston engines with up to 26 cylinder bores 5 have been envisaged, which means that a very large through-shaft 3 can be obtained. In this connection, see FIG. 4. The cylinder bores 5 are also formed with the full diameter right through. They therefore have no constriction at the aperture 6 where they adjoin the valve plate 7. The valve plate 7 is shown here with its surface 8 which comes in contact against the cylinder casing 2 formed with conical or spherical shaping. The corresponding surface on the cylinder casing 2 is also conical or spherical.

The hydrostatic forces which arise at the contact surface 8 between the valve plate 7 and the cylinder casing 2 and which urge the cylinder casing 2 away from the valve plate 7 are partly compensated by the loaded area of the working pistons 4, according to a known principle. The remaining force which is required for compensation to the desired extent is developed by the hydrostatic bearings 9 which are disposed in a ring round the axis of rotation 1—one bearing pocket 9 per cylinder bore 5. In the embodiment shown the hydrostatic bearing 9 acts axially, but the bearing may also be designed for another direction of force. The important point is that the sum of the forces and the directions of force of the pistons 4 and he hydrostatic bearings 9 correspond to the hydrostatic force and the direction of force at the contact surface 8 between the cylinder casing 2 and the valve plate 7.

In the embodiment shown in FIG. 1 the centre axis 10 of the hydrostatic bearing pocket 9 lies at approximately the same radial distance from the axis of rotation 1 of the machine as does the centre of force 11 on the effective surface on the contact surface 8 between the valve plate 7 and the cylinder casing 2. The hydrostatic bearing 9 is shown here in the special linear sealed embodiment which is described in Swedish Patent application No. 8102435-8, but other types of hydrostatic bearings are also possible, such as sliding shoe bearings or the so-called "Thin Land bearings" and the like. The number of hydrostatic bearing pockets 9 is the same as the number of cylinder bores 5 in the cylinder casing 2. Each bearing pocket 9 has its own working medium supply via a bore 12 from the respective cylinder bore 5 via an aperture 13 in the cylinder wall near the end 6 of the cylinder bore at the contact surface 8.

The hydrostatic bearing 9 slides up against the stationary force-absorbing part 14 which is rigidly connected to the housing 15 of the diagonal piston machine.

The cylinder casing 2 is rotated with the drive shaft 3 by means of the entrainment component 16.

The other ends 17 of the working pistons 4 are mounted in a drive plate (see FIG. 4), which in turn transmits torque to the drive shaft 3 of the diagonal piston machine, via a homokinetic drive coupling such as a Rzeppa coupling 18, for example.

FIG. 2 shows part of the contact surface 8 between the valve plate 7 and the cylinder casing 2. The circle indicated in a broken line is the opening 6 of the cylinder bore against the valve plate 7. This opening lies above the plane of the paper in FIG. 2. Only the part of the valve plate surface 8 which co-acts with one single cylinder opening 22 is shown, i.e. ±20° in a 9-piston machine.

When the diagonal piston machine is operating the cylinder bore 5 and the valve plate 7 are loaded with a specific amount of pressure, the sealing sliding surfaces 20 and 21 being loaded with a pressure gradient between full working pressure and housing pressure. In the space between the sliding surfaces 20 and 21 where the cylinder opening 22 terminates full working pressure prevails. The forces which arise due to the pressure ratios at right-angles to the sliding surfaces 20 and 21 and which urge the cylinder casing 2 away from the valve plate 7 can be regarded as acting on a centre of force 11, 23, the position of which is determined by the geometric conditions, i.e. the number of cylinder bores 5, the width of the sealing sliding surfaces 20, 21, the thickness of the material between the cylinder openings 6, 22 in the cylinder casing 2, and the angle of inclination of the contact surface 8 relative to the axis of symmetry 1, for example. This centre of force 11, 23 generally lies at a greater radial distance from the centre of rotation 1 than do the respective cylinder openings 6, 22.

FIG. 3 shows a version of the diagonal piston machine where the valve plate 37 is made plan-parallel, and the surface 36 adjoining the cylinder casing 32 is at right-angles to the axis of symmetry 31 of the machine. The hydrostatic forces which arise at the contact surfaces 36, 38 between the valve plate 37 and the cylinder casing 32 urge them away from each other in a direction at right-angles to the contact surfaces 36, 38, i.e. parallel to the axis of symmetry 31 of the machine. Since, as described above, the cylinder bores 35 and the pistons 34 are inclined at a considerable angle $\alpha$ to the axis of symmetry 31 of the machine, the direction of the reaction forces developed by the pistons 34 against the cylinder casing 32 is also at an angle and is not parallel to the hydrostatic forces which are developed at the contact surfaces 36, 38 between the valve plate 37 and the cylinder casing 32.

In order to produce a force which is orientated at an angle in the opposite direction and which will compensate to the desired extent the angled piston forces described above, the hydrostatic bearings 39 are positioned with their centre axes 40 at an angle $\alpha$ counter to the angle $\alpha$ so that the piston forces developed from the pistons 34 and the bearing forces from the hydrostatic bearings 39 together correspond approximately with regard to direction and magnitude, and overcome the hydrostatic forces which are developed at the contact surfaces 36, 38 between the valve plate 37 and the cylinder casing 32. The hydrostatic bearings 39 (one for each cylinder bore 35) obtain their working medium supply through a bore 42 from the respective cylinder bore 35 via an opening 43 in the cylinder wall near the end of the cylinder bore at the contact surfaces 36, 38. They slide against the stationary force-absorbing part 44 which is rigidly connected to the housing 45 of the diagonal piston machine. The sliding surface 46 on the part 44 is shaped spherically with a radius and centre positioning such that the direction of the forces developed by the hydrostatic bearings 39 is as intended, i.e. the normal to the plane which passes through the contact line between the sealing ring of the respective bearing 39 and the spherical surface 46 forms the angle $\alpha$ with the axis of symmetry 31 of the diagonal piston machine.

FIG. 4 shows an actual embodiment of a complete diagonal piston machine in section, with a very large through-shaft 52 with a diameter of 130 mm. The machine is constructed with 26 cylinder bores 55 with a diameter of 24 mm, and pistons 54 with a stroke length of 176 mm. The displacement of the machine amounts to 2070 $cm^3$/revolution. FIG. 4 also shows an example of how the mounting for the drive plate 56 can be designed.

The drive plate 56 is rigidly connected to the outer ring 64 of the homokinetic drive coupling 58, the Rzeppa coupling, the inner ring 65 of which is mounted on splines 66 on the hollow shaft 53. The drive ends 57 of the pistons are fixed to the drive plate 56. The pistons 54 with piston rods have a bore through them and conduct working medium to hydrostatic bearing pockets 59, one for each piston 54, 57, on the lower face of the drive plate, which develop bearing forces directed counter to the piston forces.

The hydrostatic bearings 59 slide against a bearing surface 60 on the part 61 which is the force-absorbing part, and are suspended by bearing pins in a bearing (not shown in the Figure) in the housing 63 of the machine and can thus rotate through an angle of $\pm\beta$ around an axis 51 at right-angles to the plane of the paper. The forces at an angle to the hollow shaft 53 which are produced by the slanting pistons 54, 57 acting against the drive plate 56 are transmitted from this to the force-absorbing part 61 by means of roller elements 62 (roller bearings).

The principle and design of the invention will have become apparent from the above description and the accompanying drawings. It will have been appreciated that the object of the invention is to make possible in a hydraulic machine, by means of hydrostatic bearings, the use of cylinder through-bores with the full area, and the orientation of these bores with their axes at a considerable angle of inclination relative to the cylinder casing and the axis of symmetry of the hydraulic machine. By this means firstly improved flow behaviour is obtained for the working medium used, but also significantly longer stroke length for the working pistons of the hydraulic machine compared with that of all known types of hydraulic piston machine. This gives the diagonal piston machine a very high maximum efficiency for a very small and compact machine volume.

The invention is not limited to the embodiment example shown on the drawings and described above, but may be modified within the frame work of the following Patent Claims.

I claim:

1. A piston machine comprising a plurality of diagonally working pistons spread along the circumference of the same, and which being received in cylinder bores sloping in an angle ($\alpha$) from the axis of symmetry and a valve plate of the machine and a number of hydrostatic bearings arranged to work between two relative to each other rotating machine parts, with the said cylinder bores received of one of said parts characterized by a plurality of hydrostatic bearings, which number corresponds to the number of pistons, and with respective bearing connected and arranged to work with a belonging cylinder bore, are arranged in a circle around the said axis of rotation sliding up against a stationary force-absorbing part, which is rigidly connected to a housing of the said diagonal piston machine, at approximately the same radial distance from the said axis of rotation of the machine as does the center of force on the effective surface on the contact surface between the valve plate and the cylinder casing, and thereby aimed to co-operate in pairs with a bearing for each cylinder bore that the sum of the forces and the directions of force of the pistons and the hydrostatic bearings approximately correspond to the hydrostatic force and the direction of force at the contact surface between the cylinder casing and the valve plate.

2. A piston machine according to claim 1, characterized in that the effective surface at the boundary surface between the valve plate and the cylinder casing is given conical or spherical shaping.

3. A piston machine according to claim 1, characterized in that the respective cylinder bores consist of a right through cylinder bore with the full diameter, arranged with their axis of center at a large angle ($\alpha$) in relation to said axis of symmetry, preferably larger than 5°.

4. A piston machine according to claim 1, characterized in that the effective surface at the boundary surface between the valve plate and the cylinder casing is arranged at right-angles to the axis of symmetry.

5. A piston machine according to claim 4, characterized in that the bearings are positioned with their center axes at an angle ($\gamma$) to the axis of symmetry.

6. A piston machine according to claim 5, characterized in that the sliding surface for each bearing is given spherical shaping.

* * * * *